US007989721B2

(12) United States Patent
Besana et al.

(10) Patent No.: US 7,989,721 B2
(45) **Date of Patent: *Aug. 2, 2011**

(54) LOW-VOLTAGE DEVICE WITH ROTATING ELEMENT WITH HIGH ELECTRODYNAMIC STRENGTH

(75) Inventors: Stefano Besana, Terno d'Isola (IT); Alessio Bergamini, Ardesio (IT)

(73) Assignee: ABB S.p.A., Milan (IT)

( * ) Notice: Subject to any disclaimer, the term of this patent is extended or adjusted under 35 U.S.C. 154(b) by 888 days.

This patent is subject to a terminal disclaimer.

(21) Appl. No.: 11/871,840

(22) Filed: Oct. 12, 2007

(65) Prior Publication Data

US 2008/0087532 A1 Apr. 17, 2008

(30) Foreign Application Priority Data

Oct. 13, 2006 (IT) ..... BG2006A0053

(51) Int. Cl.
*H01H 1/22* (2006.01)

(52) U.S. Cl. ..... 200/244

(58) Field of Classification Search ..... 200/244
See application file for complete search history.

(56) References Cited

U.S. PATENT DOCUMENTS

| | | | | |
|---|---|---|---|---|
| 4,594,567 | A | 6/1986 | DiMarco et al. | |
| 5,280,258 | A * | 1/1994 | Opperthauser | 335/172 |
| 5,539,167 | A * | 7/1996 | Hood et al. | 200/244 |
| 5,969,308 | A | 10/1999 | Pever | |
| 6,262,642 | B1 * | 7/2001 | Bauer | 335/16 |

FOREIGN PATENT DOCUMENTS

| | | |
|---|---|---|
| DE | 20100490 | 3/2001 |
| EP | 0177437 | 4/1986 |
| EP | 1215695 | 6/2002 |
| WO | WO-2005034162 | 4/2005 |

* cited by examiner

*Primary Examiner* — Renee S Luebke
*Assistant Examiner* — Lheiren Mae Caroc
(74) *Attorney, Agent, or Firm* — Connolly Bove Lodge & Hutz LLP

(57) ABSTRACT

A single-pole or multi-pole device for low-voltage systems, in particular a circuit breaker or a disconnector, which comprises: an outer casing containing for each pole at least one fixed contact and at least one mobile contact that can be coupled to/uncoupled from one another; a rotating element that comprises a shaped body made of insulating material comprising at least one seat for each pole of said switch, said seat being designed to house at least one mobile contact of a corresponding pole; a control mechanism operatively connected to the rotating element for enabling movement thereof; and one or more elements made of ferromagnetic material set in a position corresponding to at least one portion of the inner surface of said at least one seat of the mobile contact.

18 Claims, 12 Drawing Sheets

LOW-VOLTAGE DEVICE WITH ROTATING ELEMENT WITH HIGH ELECTRODYNAMIC STRENGTH

FIELD OF THE INVENTION

The present invention relates to a device for low-voltage systems, in particular for a circuit breaker or a disconnector with high electrodynamic strength.

BACKGROUND OF THE INVENTION

It is known that circuit breakers and disconnectors, hereinafter referred to as a whole as switches, comprise an outer casing and one or more electrical poles, associated to each of which are at least one fixed contact and at least one mobile contact that can be coupled to/uncoupled from one another.

Circuit breakers of the known art moreover comprise control means that enable displacement of the mobile contacts, causing their coupling to or uncoupling from the corresponding fixed contacts. The action of said control means is exerted traditionally on a main shaft operatively connected to the mobile contacts so that, following upon its rotation, the mobile contacts are brought from a first operative position to a second operative position, which are respectively characteristic of a configuration of switch open and switch closed.

In the case of the switches for low currents (indicatively up to 800 A), and for modest voltages (indicatively up to 690 V) there exist solutions that cause the main shaft to coincide with the mobile contacts, giving rise to a rotating element made of insulating material capable of guaranteeing both dielectric separation between the phases and, of course, proper transmission of the movements and resistance to the forces involved. The rotating element is usually supported by structural parts of the outer casing of the switch that basically define areas of bearing with the rotating element itself. Switches of this type present considerable advantages, such as, for example, a limited number of parts and a limited overall encumbrance.

The indicative technical limits of 800 A and 690 V for the switches that make use of the rotating element derive from the fact that, beyond these thresholds, there would be required of the rotating element levels of performance in terms of electrodynamic and mechanical resistance that are scarcely compatible with structural materials of an insulating type that are to have competitive costs.

From a practical standpoint, the requirement of higher mechanical characteristics has partially been met by introducing metal reinforcement bars, passing through the rotating element itself. Metal reinforcement bars pose, however, problems of interference with the characteristics of electrical insulation between the poles. In practice, modest increases of mechanical performance are inevitably accompanied by further decay of the insulation.

Another road followed in the known art for bestowing upon the rotating element higher characteristics of electrodynamic and mechanical resistance is that of increasing the radial dimensions thereof, solutions of this second type tend, however, to introduce greater friction and to jeopardize the general efficiency of the switch.

A more advanced solution, described in the patent application No. BG2005A000026 enables extension of the use of the rotating element also to switches for currents decidedly higher than 800 A by introducing bearings that suspend the rotating element itself from the control members. In particular, the latter solution reduces the friction and prevents the stresses from being transmitted by the contacts to the rotating element directly onto critical areas of the switch, such as, for example, the joints of the containment means.

Even though the latter solution enables exploitation of the switch over a particularly extensive range of levels of performance, there remain in any case physical limits of use linked not so much to the rated current, as rather to the short-circuit conditions (for example, 45 kA to 690 V).

During a short circuit, there occur in fact a number of phenomena that expose the switch to particularly serious stresses. In the first place, the switch is called upon to withstand, albeit for a short time, extremely high currents. In the second place, the switch is called upon to interrupt the short circuit effectively. The capacity of the switch to withstand for short times currents that are much higher than the rated current is known as electrodynamic strength. The capacity of the switch to interrupt the short circuit is known as breaking power.

The limits of electrodynamic strength are a consequence, for example, of the so-called phenomena of electrodynamic interference between conductors that are close to one another traversed by current. Said electrodynamic interference presents both with electrical stresses, and hence thermal stresses, and with mechanical stresses. As is known, phenomena of electrodynamic interference are triggered both between conductors traversed by similar currents (such as, for example, between the various branches in parallel that form one and the same pole made up of a number of contacts) and between conductors that are close to one another traversed by different currents (such as, for example, between contiguous poles of a multiphase switch). In the case, for example, of similar conductors in parallel (as occurs between the various contacts of one and the same pole), considerable imbalance is encountered in the distribution of the current between the various contacts, also when the contacts have identical or similar morphological characteristics. For example, in the case of five conductors that are the same as one another, it is realistic to expect imbalance of a ratio of even in the region of three to one between the external conductors and the internal ones. In particular, in the case of short circuit the limits of electrodynamic strength will be reached rapidly by the external contacts that are subjected to higher electrical stresses.

The electrodynamic strength of a pole can thus be considered to a first approximation as the sum of the currents circulating in all the contacts of a pole as long as the outermost contacts remain in conditions of safety. In other words, it may be said that the various contacts do not contribute equally to form the electrodynamic strength of the pole.

The electrodynamic phenomena between conductors traversed by different currents are more complex because they derive from situations with a higher degree of variability, but in the ultimate analysis lead to further limitations of the electrodynamic strength in conditions of safety.

In particular, it may be noted that in multi-pole switches, since the external contacts of the individual poles are the ones subjected by the current to the higher stresses, the phenomena of interference between adjacent poles are in turn disadvantageously amplified.

It is known that the electrodynamic strength can be theoretically improved by increasing the distance between the electrical parts corresponding to contiguous poles, and/or using particularly strong contact springs, and/or by varying the geometry of the individual contacts. However, for the reasons already set forth, the modifications in this sense sooner or later come into conflict with dimensional constraints, with economic constraints on the cost-to-benefit ratio, and with the technical limits of the materials generally available.

Finally, not to be neglected is the fact that the electrodynamic interference presents also in the form of mechanical stresses, above all between different poles. It is necessary in fact to bear in mind that both the purely electrical parts of the pole and the various mechanical elements present in the neighbourhood and in the cavities of the rotating element can be variously traversed by electric currents. Along the electrical and kinematic chain of the pole, there are encountered in fact numerous metal elements and hence elements that conduct current (such as mobile contacts, springs, connecting rods, pins, flexible conductive elements) supported by and constrained both to one another and to the rotating element itself. In particular, said electrical and mechanical parts, if traversed by a component of the current of the pole, are exposed to mechanical stresses. Said stresses depend upon the currents involved, and in conditions of short circuit, the stresses produced can easily interfere with the limits of yielding and failure of the various materials. Excessive stresses can in fact cause mechanical seizing and failure both of the metal parts and of the plastic material that constitutes the rotating element. It is thus evident that also the mechanical phenomena deriving from the electrodynamic interference contribute to limiting the overall electrodynamic strength of the switch.

As regards the electromechanical parts, it should be pointed out that also momentary or limited mechanical deformations can easily jeopardize proper functioning of the switch.

As regards the shaped body of the rotating element, it should be recalled, instead, that, since it is an insulating material, the limit of yielding can be relatively modest, also when high-quality plastic materials are used, such as, for example, the so-called moulding compound with a base of unsaturated polyester.

It is clear that, if it is desired to achieve further increased performance for the switch (for example, with electrodynamic strength higher than 45 kA to 690 V), it would be necessary to be able to contain the electrodynamic stresses.

SUMMARY OF THE INVENTION

The main technical aim of the present invention is to provide a switch that will enable the limits and the drawbacks just referred to to be overcome.

In the framework of this task, a purpose of the present invention is to provide a switch that presents a compact structure that can be easily assembled and is made up of a limited number of components.

Another task of what forms the subject of the present invention is to provide a switch with improved characteristics of electrodynamic strength.

Yet a further task forming the subject of the present invention is to provide a switch that, by virtue of the improved characteristics of electrodynamic strength, will present also improved characteristics of breaking power.

Not the least important purpose of what forms the subject of the present invention is to provide a switch that will present high reliability and is relatively easy to produce at competitive costs.

The above task, as well as the above and other purposes that will appear more clearly in what follows, are achieved by a single-pole or multi-pole device for low-voltage systems, in particular a circuit breaker or a disconnector, characterized in that it comprises:

an outer casing containing for each pole at least one fixed contact and at least one mobile contact that can be coupled to/uncoupled from one another;

a rotating element comprising a shaped body made of insulating material comprising at least one seat for each pole of said switch, said seat being designed to house at least one mobile contact of a corresponding pole;

a control mechanism operatively connected to said rotating element for enabling movement thereof, and at least one element made of ferromagnetic material set in a position corresponding to at least one portion of the inner surface of said at least one seat of each pole of the rotating element.

In the device according to the invention, thanks to the presence of the element or elements made of ferromagnetic material the problems typical of the switches of the known art are overcome. In particular, the elements made of ferromagnetic material limit the electrodynamic interference, and hence the electrical and dynamic stresses both on the electrical and mechanical parts present in the neighbourhood and in the cavities of the rotating element and variously traversed by electric currents and on the rotating element itself, enabling increase of the performance of the switch, in particular in terms of electrodynamic strength and breaking power.

In practice, the elements made of ferromagnetic material, appropriately positioned in the seats of the mobile contacts, by limiting the stresses on the electrical and mechanical parts traversed by electric currents, reduce the risks of seizing or failure both of said parts and of the shaped shaft of the rotating element.

The elements made of ferromagnetic material, appropriately positioned in the seats of the mobile contacts, by limiting also the phenomena of non-uniform distribution of the current between the various contacts of the individual poles, also enable the internal contacts to provide a significant contribution to the electrodynamic strength and, in the case of multi-pole switches, to limit sensibly the harmful phenomena of interference between contiguous poles.

Further characteristics and advantages of the invention will emerge more clearly from the description of preferred, but not exclusive, embodiments of a device according to the invention, illustrated by way of example in the annexed drawings. In the attached figures, the invention is illustrated with reference to a low-voltage circuit breaker, without thereby wishing to limit in any way application thereof also to other types of low-voltage devices, such as, for example, disconnectors. Furthermore, even though reference is herein made to multi-pole switch, the present invention is applicable also to single-pole devices.

DESCRIPTION OF THE PREFERRED EMBODIMENTS

Figure 1:
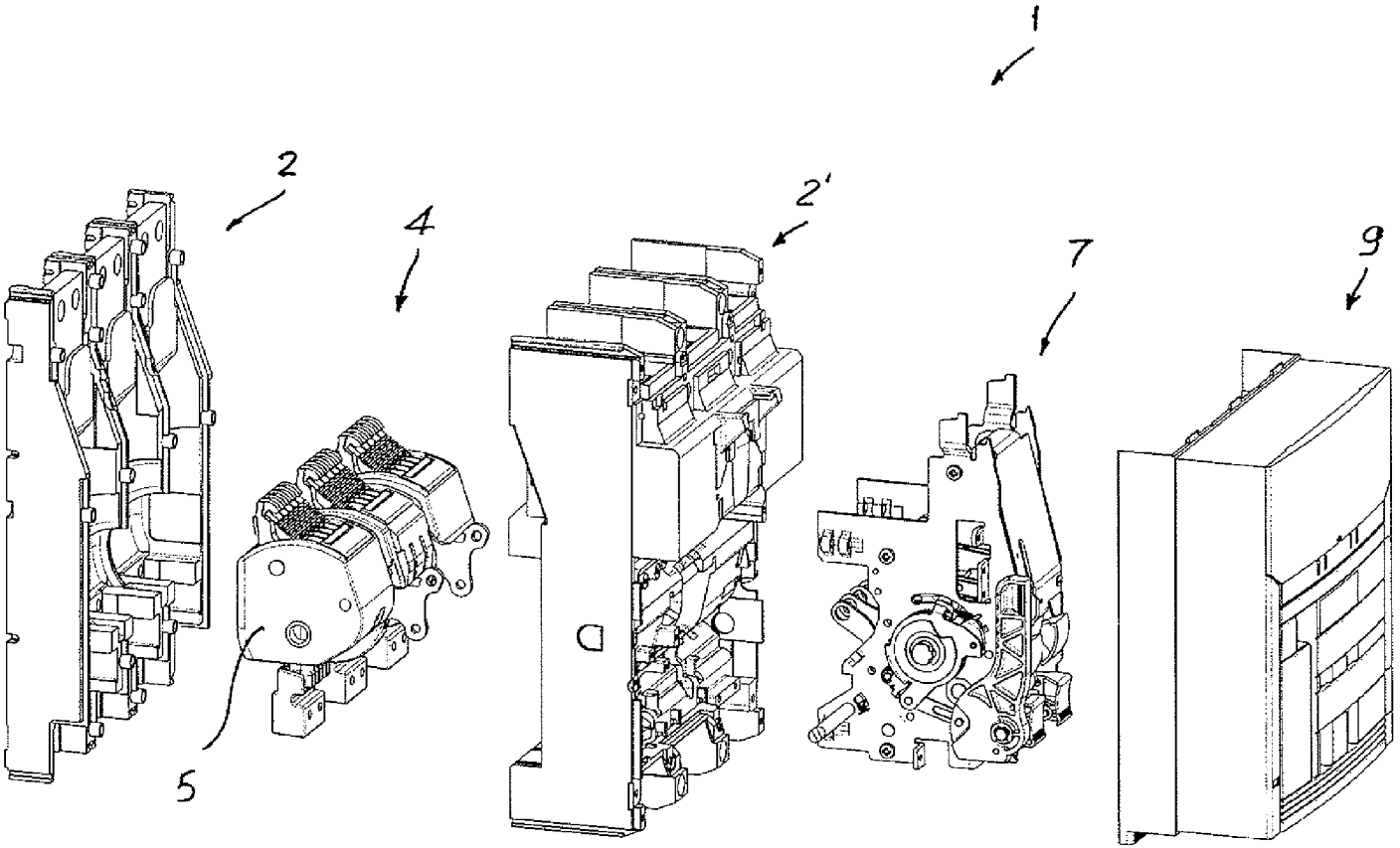
FIG. 1 is an exploded view of a low-voltage circuit breaker according to the invention.

With reference to the attached figures, the device for low-voltage systems according to the invention, in this case a circuit breaker 1, comprises an outer casing, which in the embodiment illustrated comprises two half-shells 2 and 2'. The half-shells house a plurality of poles, in this case three, each of said poles containing at least one fixed contact and at least one mobile contact 3 that can be coupled to/uncoupled from one another. The mobile contact 3 can be made of a single piece or else of a plurality of pieces adjacent to one another, as clearly illustrated in FIG. 2.

The circuit breaker moreover comprises a rotating element 4 that is defined by a shaped body 5 made with an insulating material. In a position corresponding to each pole of the circuit breaker, the shaped body 5 comprises at least one seat 6 that is designed to house at least the mobile contact 3 of the corresponding pole. Advantageously, the mobile contacts of each pole can be equipped with contact springs 14, configured, for example, as in any solution of the known art. In order to enable movement of the rotating element 4, the circuit breaker 1 also comprises a control mechanism 7 that is operatively connected to said rotating element 4. Furthermore, a closing mask 9 is generally present; said mask 9 is usually applied on one of the half-shells 2' and can if necessary be easily removed by an operator in order to gain access to the internal parts of the circuit breaker 1.

For a detailed description of an example of switch, the reader is referred to the patent application No. BG2005A000026, the description of which is incorporated herein for reference.

The circuit breaker according to the invention moreover comprises elements made of ferromagnetic material that are positioned in the seat 6 of the mobile contact 3, made in the shaped body 5 of the rotating element 4. In the device according to the invention, the elements made of ferromagnetic material are in general shaped and positioned in such a way as to be kept fixed with respect to said shaped body 5 and coat at least one portion of the inner surface of the seat 6.

With reference to the attached figures, it may in fact be noted how the elements made of ferromagnetic material form a coating of at least part of the internal surfaces of the seats 6 of the mobile contact 3. In principle, the containment of the electrodynamic interference improves as the proportion of the coated, and hence shielded, area of the seats 6 of the mobile contacts increases. On the other hand, it is necessary to respect the physical limits dictated, for example, by the presence of other components or by the dielectric distances that determine galvanic separation between contiguous poles.

Preferably, said one or more elements made of ferromagnetic material coat at least 25% of the inner surface of said seat 6. It has in fact been noted from experiments that elements made of ferromagnetic material even of modest dimensions, such as, for example, the ones illustrated in FIG. 11, which provide a covering of approximately 25% of the internal surfaces of the seats 6, enable an increase in the electrodynamic strength of approximately 8% to be obtained (49 kA to 690 V all other conditions being equal). The size, shape and continuity of the elements of magnetic shielding hence do not represent a particularly critical factor.

The seat 6 preferably has a first side wall 91 and a second side wall 92, opposed to one another. In this case, conveniently, the elements made of ferromagnetic material are set in a position corresponding to said first side wall 91 of the seat 6, and, more preferably, said elements are set in a position corresponding to at least said first side wall 91 and second side wall 92 of said seat 6.

Figure 2:
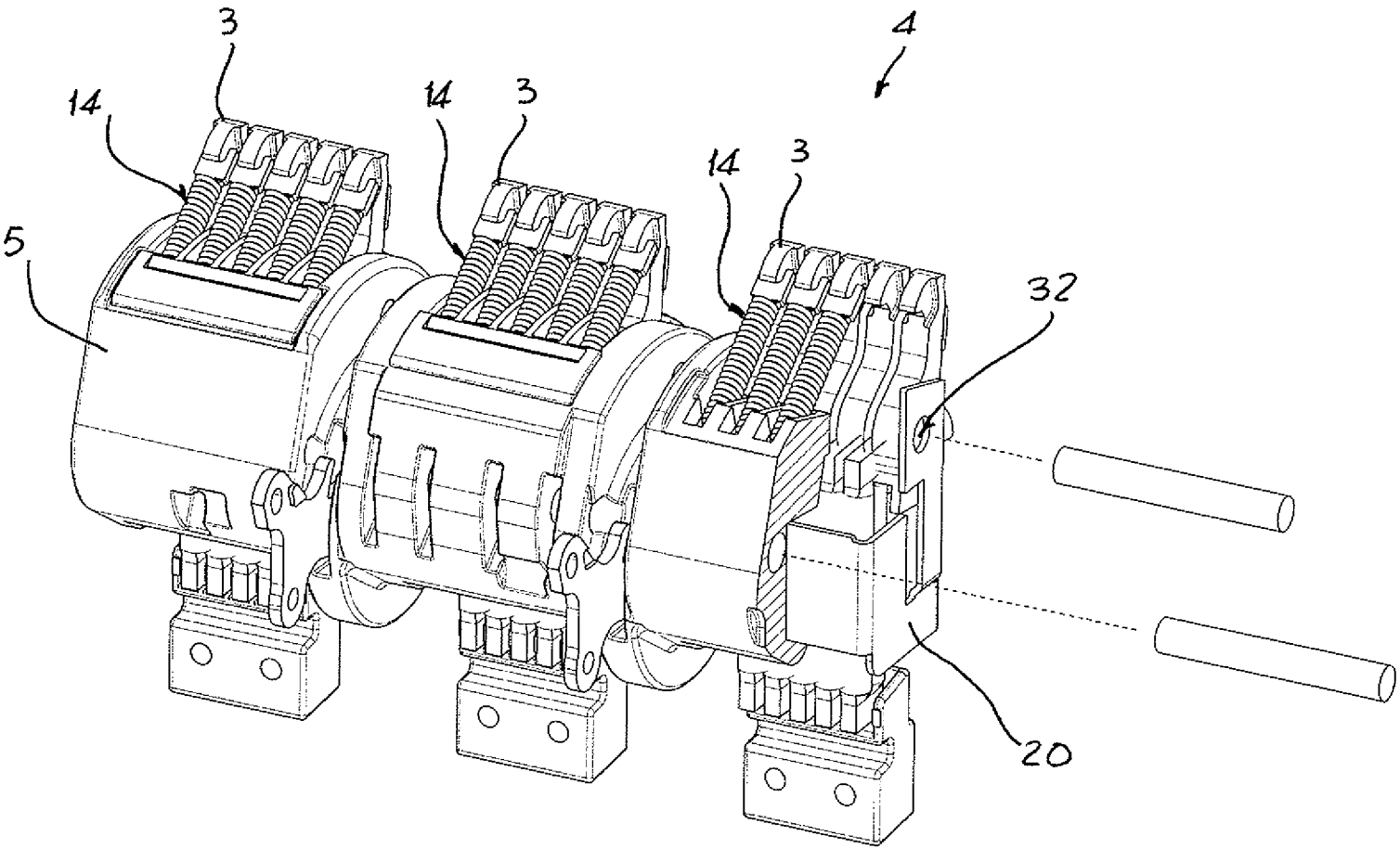
FIG. 2 is a partial cross-sectional view of a rotating element of a low-voltage device according to the invention.
Figure 8:
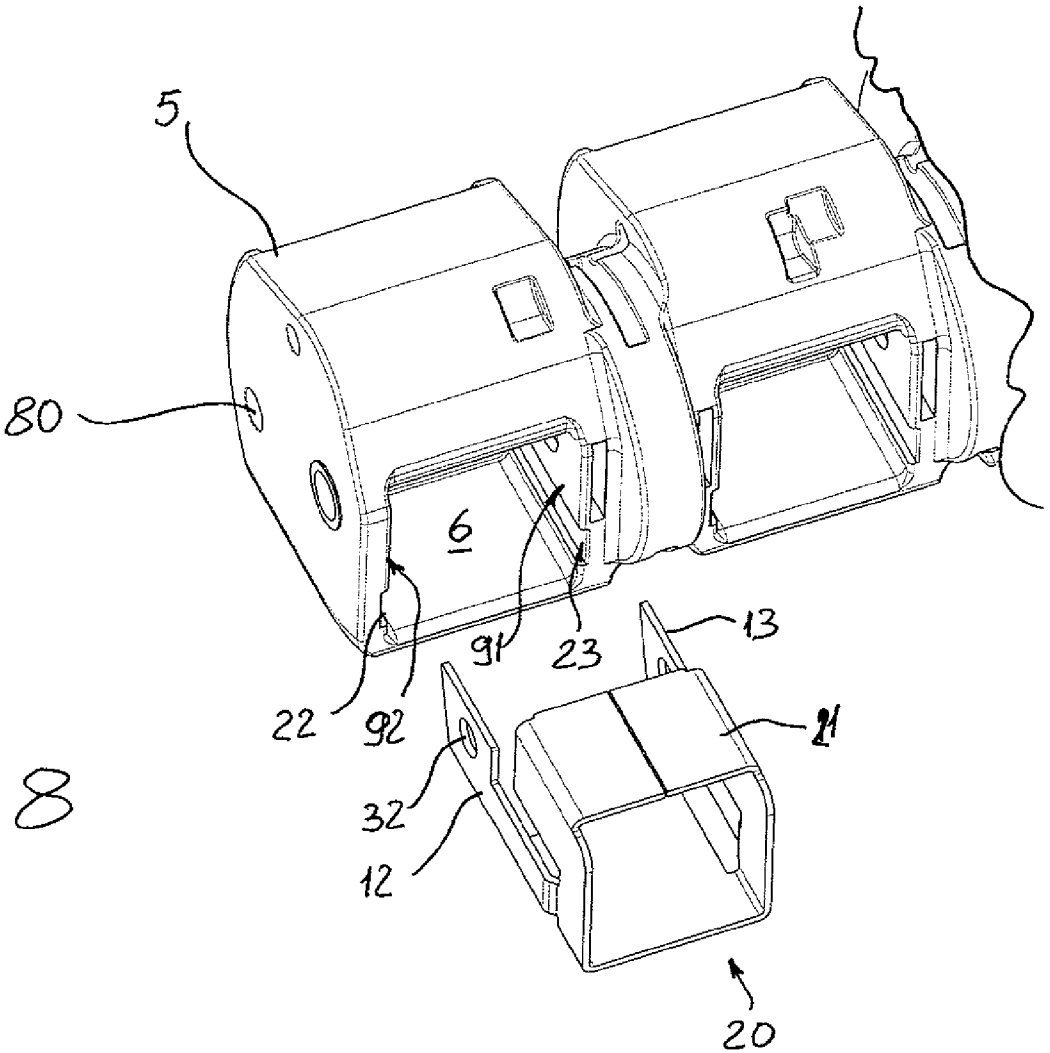
FIG. 8 is a view of a portion of rotating element and of a corresponding element made of ferromagnetic material according to the embodiment of FIG. 4.

With reference to FIGS. 2 and 8, according to a particular embodiment, the elements made of ferromagnetic material are kept in position by the pin of the mobile contacts 8. In this case, in practice, the elements of magnetic shielding interact operatively with said pin of the mobile contacts 8 and with the shaped body 5, and concur to distribute the action of thrust or of tugging on an extensive and not concentrated portion of the rotating element 4. By the expression "interact operatively with said pin of the mobile contacts 8 and with the shaped body 5" it is meant that, thanks to this particular conformation of the elements of magnetic shielding, the stresses, instead of being concentrated in the proximity of the hole 80 for passage of the pin of the mobile contacts 8, are distributed over a relatively extensive region of the shaped body 5. In this case, then, the elements made of ferromagnetic material, in addition to exerting an action of shielding, also exert an action of mechanical reinforcement of the shaped body 5 of the rotating element 4.

Figure 3:
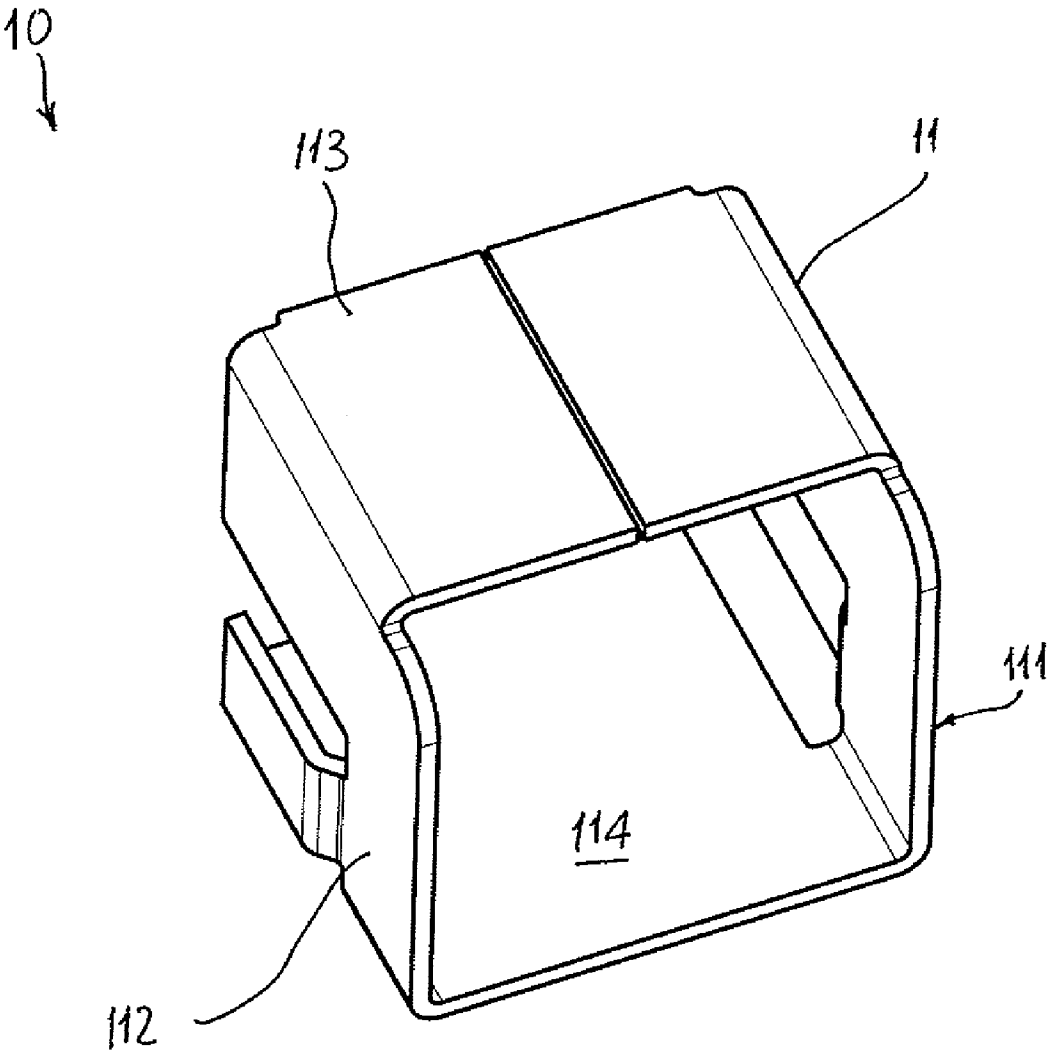
FIG. 3 is a perspective view of a first embodiment of an element made of ferromagnetic material used in a low-voltage device according to the invention.

The shape, dimensions and location of the elements made of ferromagnetic material can be different according to the needs. For example, with reference to FIG. 3, in a first embodiment, the elements made of ferromagnetic material can substantially comprise a first shaped body 10, which has a hollow portion with substantially rectangular cross section 11. The outer surface of the portion 11 is shaped so as to substantially mate with the inner surface of the seat 6 made in the shaped body 5 of the rotating element. In other words, the walls 111, 112, 113, 114 of the portion 11 are designed to couple with the internal walls of the seat 6, coating them either totally or in part.

Figure 4:
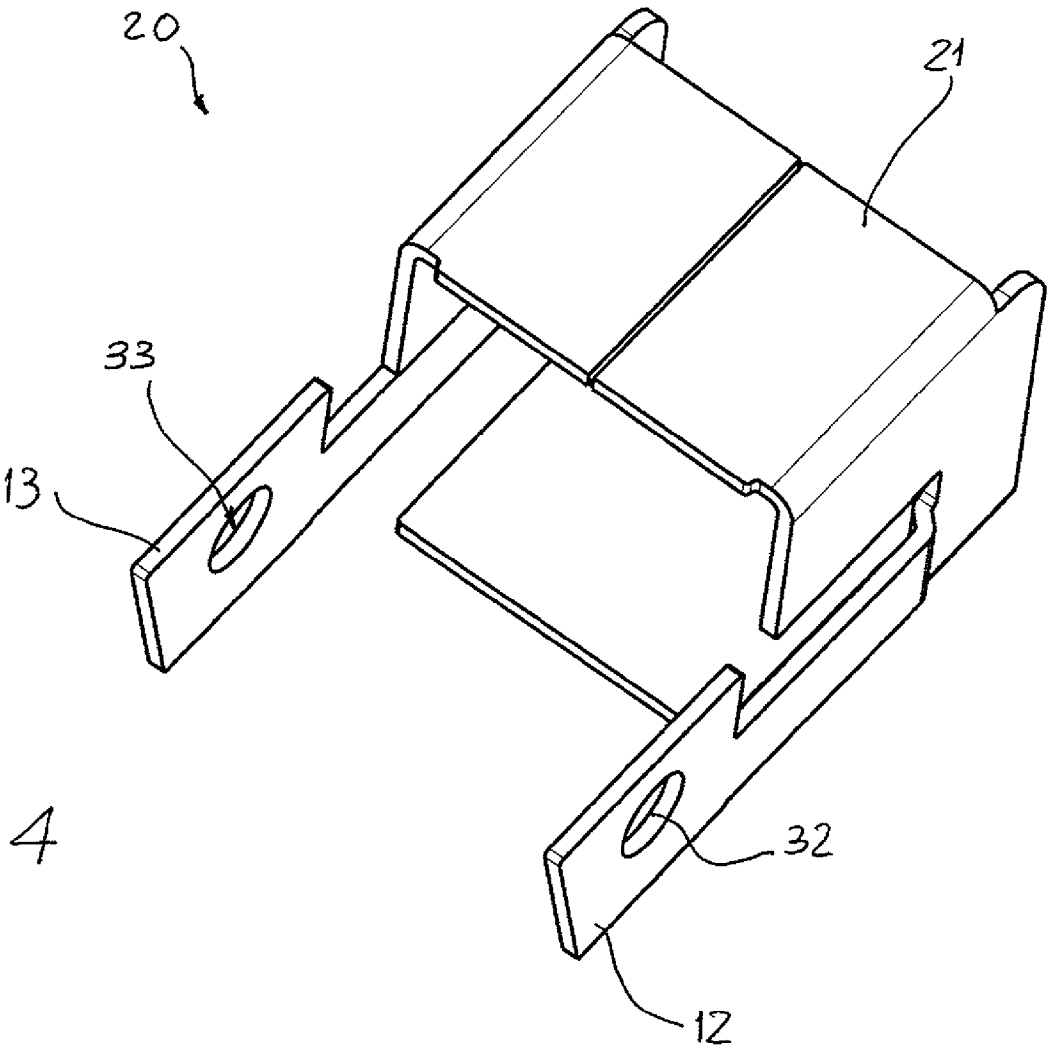
FIG. 4 is a perspective view of a second embodiment of an element made of ferromagnetic material used in a low-voltage device according to the invention.
Figure 5:
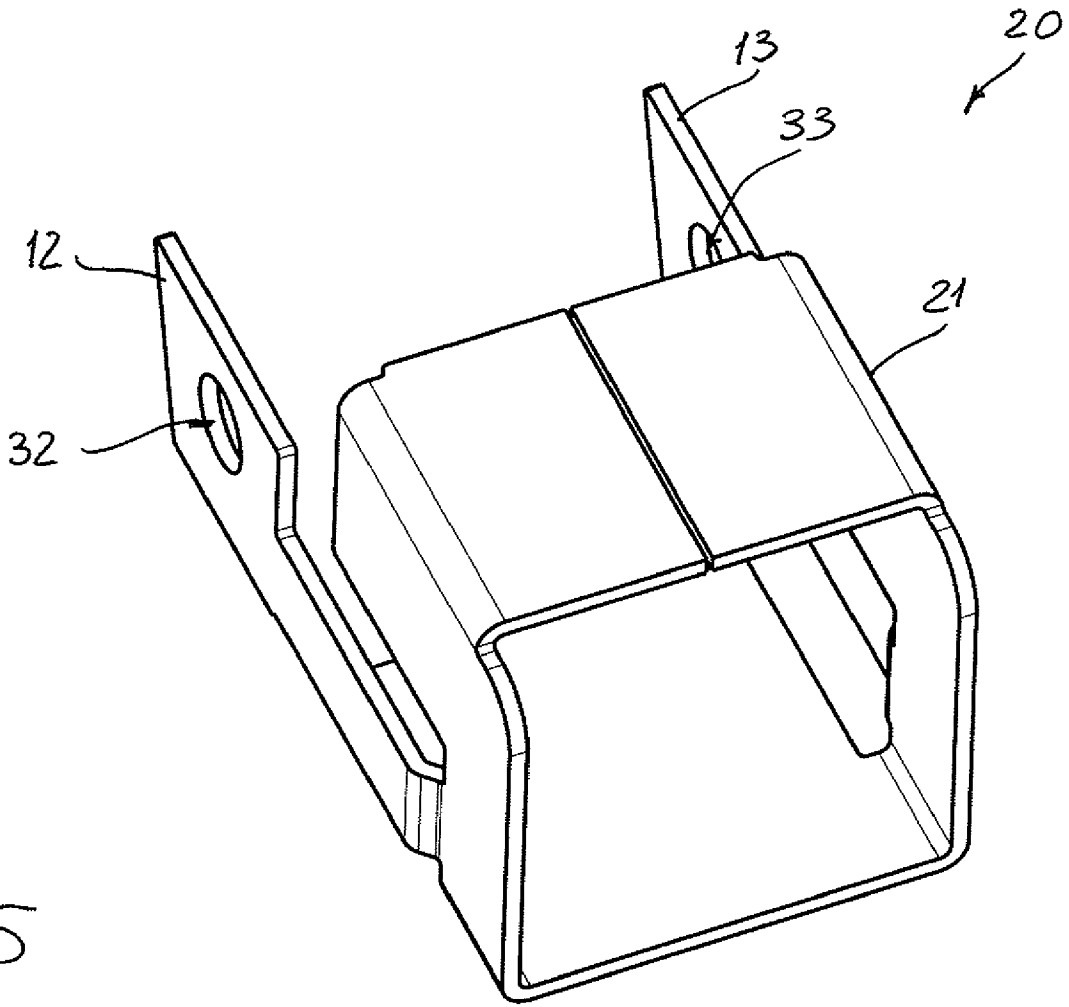
FIG. 5 is a further view of the element of FIG. 4.

With reference to FIGS. 4, 5 and 8, in a first embodiment, the elements made of ferromagnetic material can substantially comprise a second shaped body 20, which has a hollow portion with a substantially rectangular cross section 21. The outer surface of the portion 21 is shaped so as to substantially mate with the inner surface of the seat 6 made in the shaped body 5 of the rotating element (see FIG. 8). The shaped body 21 of the element made of ferromagnetic material moreover comprises a first tab 12 and a second tab 13, which extend from the hollow portion 21 of the shaped body 20. With reference to FIG. 8, the tabs 12 and 13 preferably project from the width of the rectangular hollow portion 21 so as to engage, for example, by snap action, in corresponding housings 22 and 23, defined in the side walls 92 and 91 of the seat 6.

Preferably, defined on said first tab 12 and second tab 13 are a first hole 32 and second hole 33 for passage of said pin of the mobile contacts 8. In this way, the stresses generated in a position corresponding to the pin of the mobile contacts 8, instead of being concentrated on a limited area adjacent to the hole 80, can be distributed over a far more extensive surface.

Figure 6:
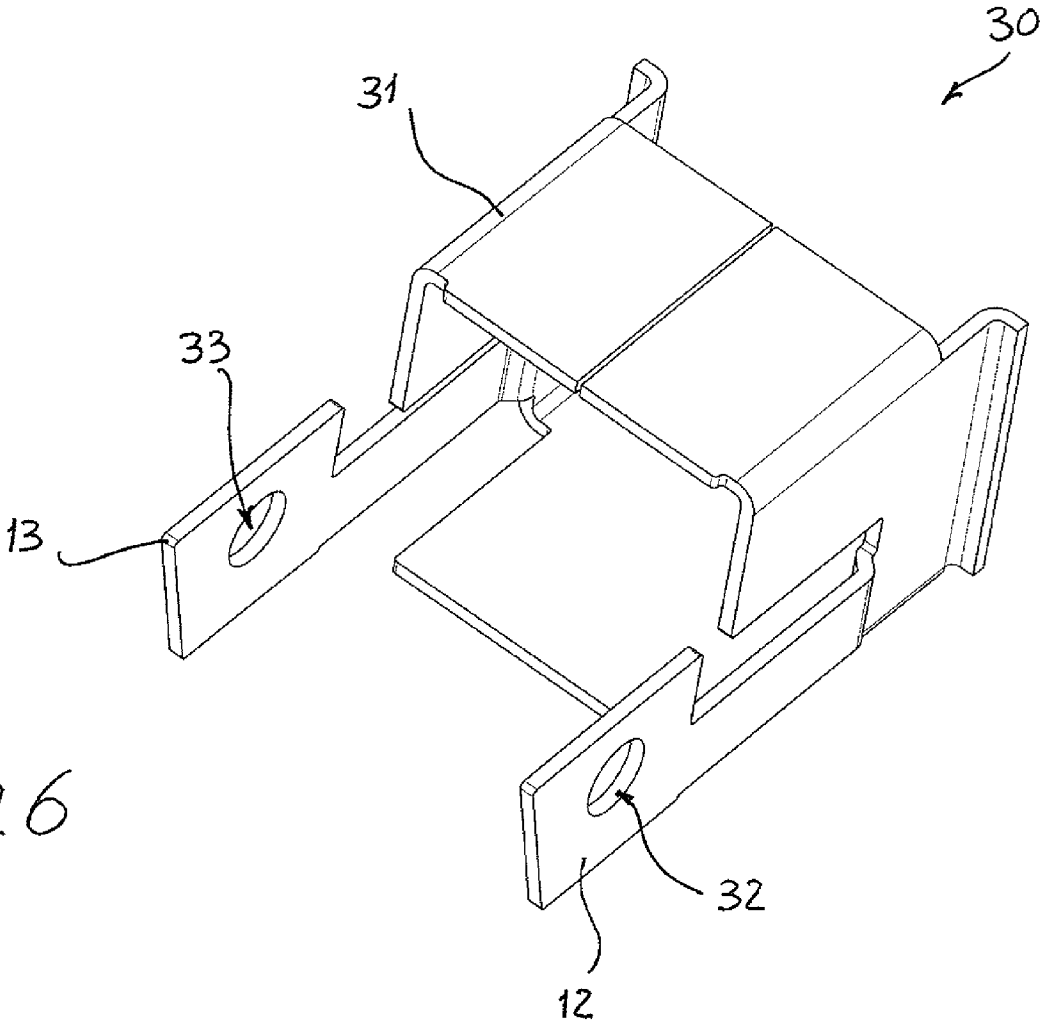
FIG. 6 is a perspective view of a third embodiment of an element made of ferromagnetic material used in a low-voltage device according to the invention.

According to a particular embodiment, with reference to FIG. 6, at least one part of the outer perimeter of the hollow portion 31 of the element made of ferromagnetic material 30, has a bent-over edge 35, designed to co-operate with a corresponding coupling surface, defined on the shaped body 5. The term "outer perimeter" is intended to indicate the area of hollow portion 31 of the element 30 closest to the mouth of the seat 6 once the element made of ferromagnetic material 30 has been inserted in said seat 6 according to the modalities illustrated in FIG. 8.

The element made of ferromagnetic material 10, 20, 30 illustrated in FIGS. 3 to 6 can advantageously be made of a single piece, appropriately shaped and bent. Once inserted in the seat 6, the element made of ferromagnetic material remains easily in position thanks to the interaction between the outer surface of the hollow portion 11, 21, 31 and the inner surface of the seat 6, as well as, in the cases illustrated in FIGS. 4, 5, 6, thanks to the interaction between the tabs 12, 13 and the corresponding seats 22, 23.

Figure 7:
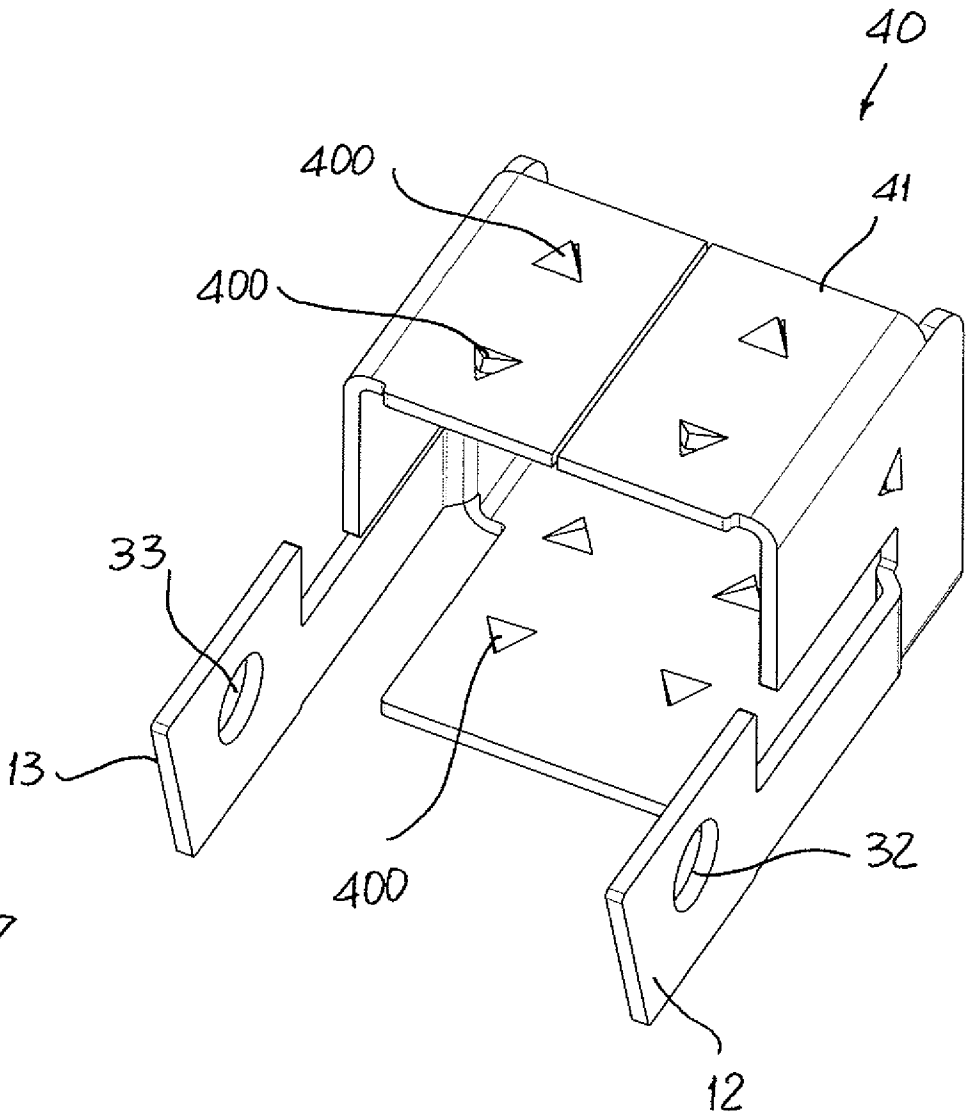
FIG. 7 is a perspective view of a fourth embodiment of an element made of ferromagnetic material used in a low-voltage device according to the invention.

According to an alternative embodiment, illustrated in FIG. 7, the element made of ferromagnetic material 40 can advantageously comprise crimping means 400, designed to favour coupling between the ferromagnetic element itself and the shaped body 5. This is particularly advantageous in the case where the positioning of the element made of ferromagnetic material within the seat 6 is obtained by co-moulding, via insertion of the element 40 in the mould of the shaped body 5 of the rotating element 4.

Figure 9:
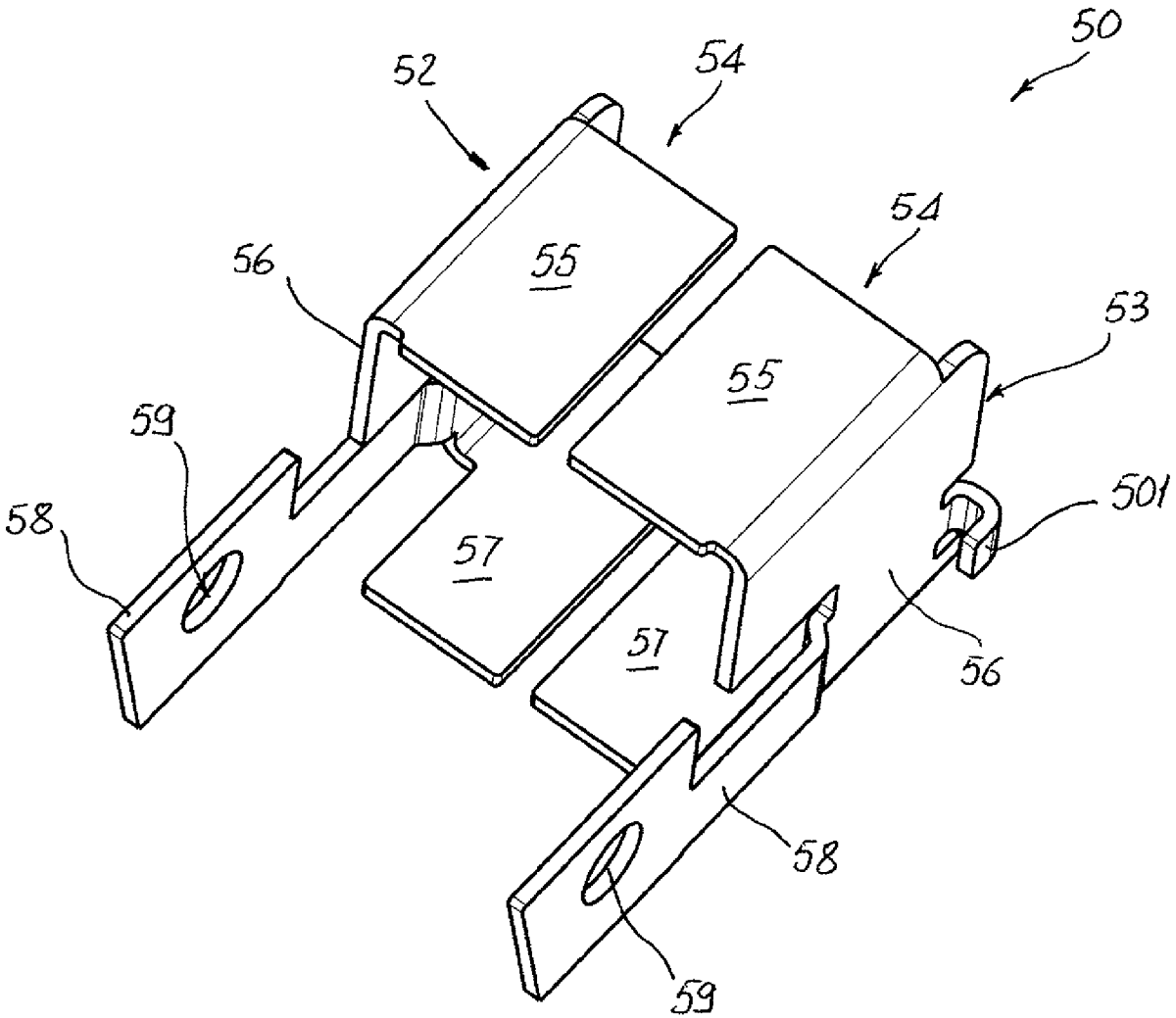
FIG. 9 is a perspective view of a fifth embodiment of an element made of ferromagnetic material used in a low-voltage device according to the invention.
Figure 10:
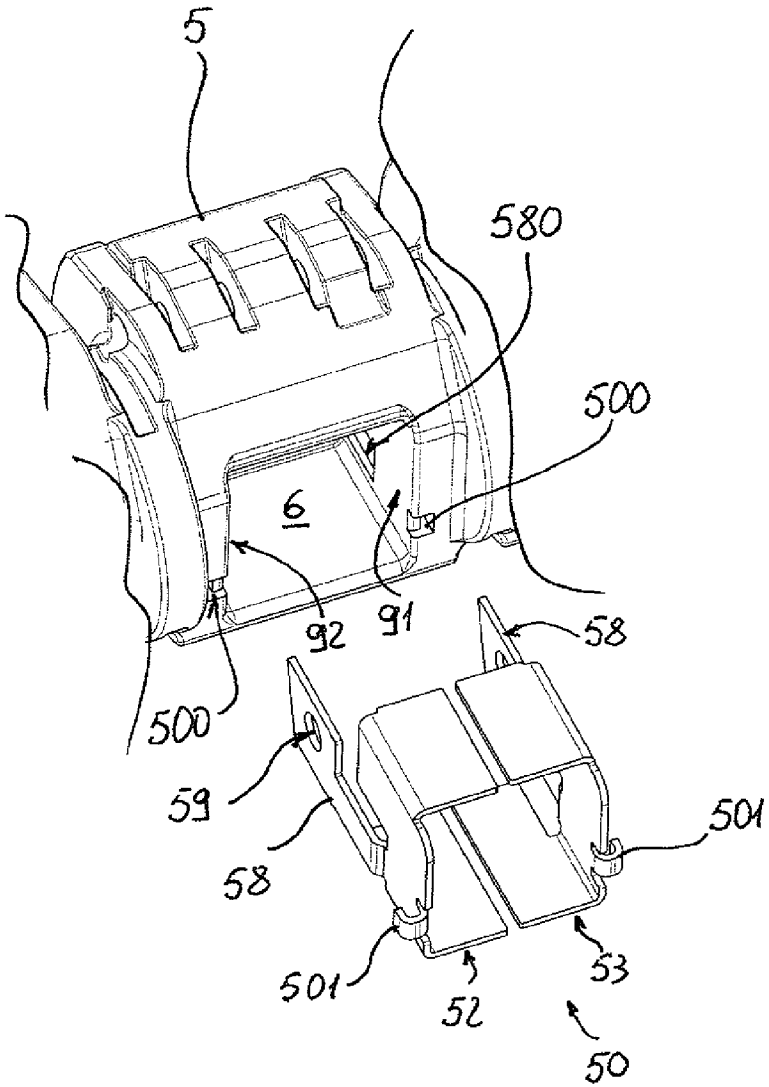
FIG. 10 is a view of a portion of rotating element and of a corresponding element made of ferromagnetic material according to the embodiment of FIG. 9.

An alternative embodiment, illustrated in FIGS. 9 and 10, envisages that the elements made of ferromagnetic material 50 comprise a second shaped body 52 and a third shaped body 53. Each of said second and third shaped bodies 52, 53 has a first hollow portion 54 with substantially U-shaped cross section, defined by a first wall 55, a second wall 56 and a third wall 57 substantially perpendicular to one another. The outer surface of the hollow portion 54 is made so as to mate substantially with at least one portion of the inner surface of said seat 6. A third tab 58 extends from said second wall 56 and engages, for example by snap action, in corresponding housings 580, defined in the seat 6 of the shaped body 5. As illustrated in FIG. 10, the second and third shaped bodies 52, 53 are inserted in the seat 6 so that the respective hollow portions 54 face one another. Preferably, defined on said third tab 58 is a third hole 59 for passage of said pin of the mobile contacts 8.

In order to improve the ease of positioning in the seat 6, the second and third shaped bodies 52, 53 can advantageously have engagement means 501 designed to engage in corresponding housings 500, defined on said shaped body 5 of said rotating element.

Figure 11:
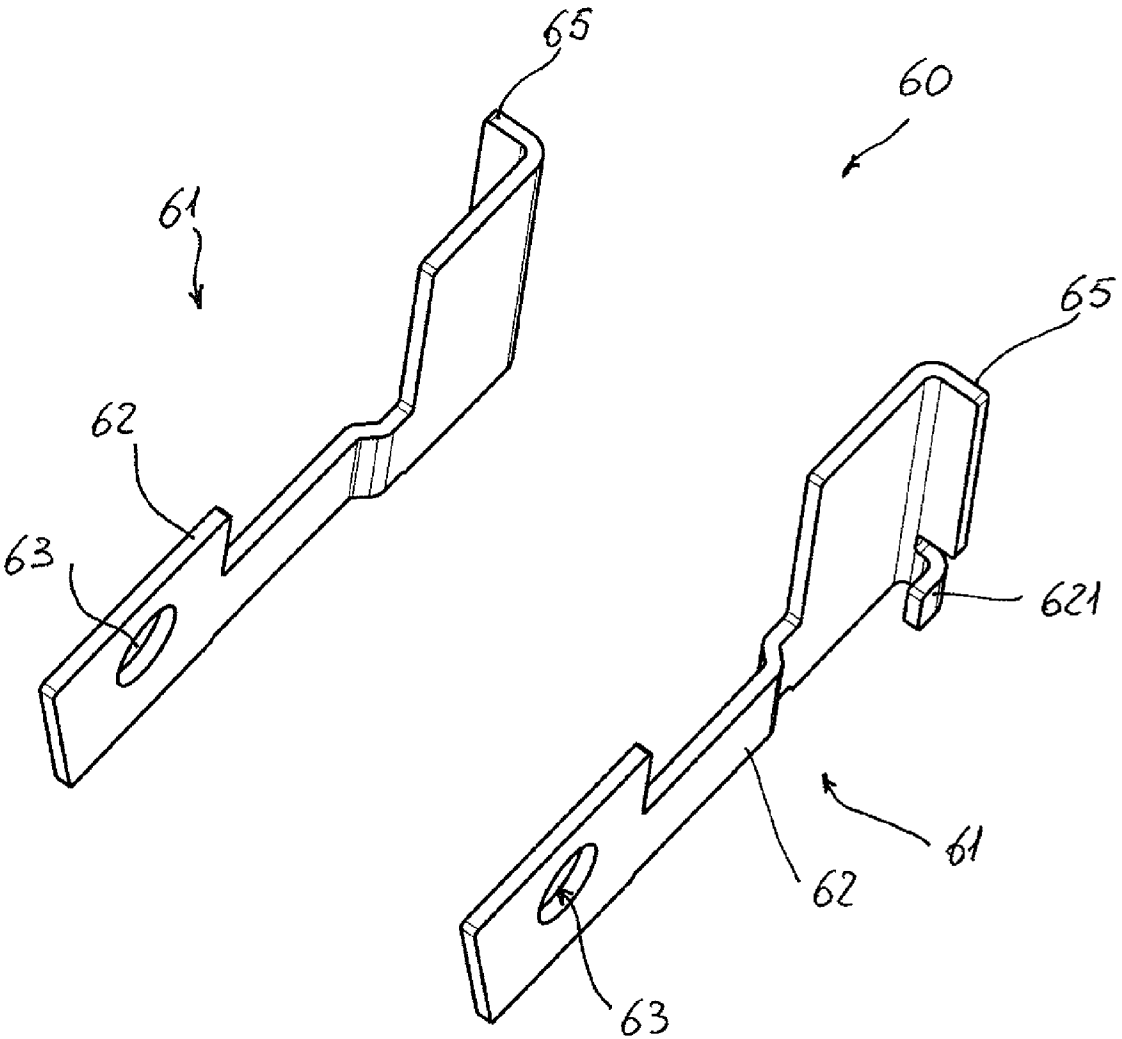
FIG. 11 is a perspective view of a sixth embodiment of an element made of ferromagnetic material used in a low-voltage device according to the invention.
Figure 12:
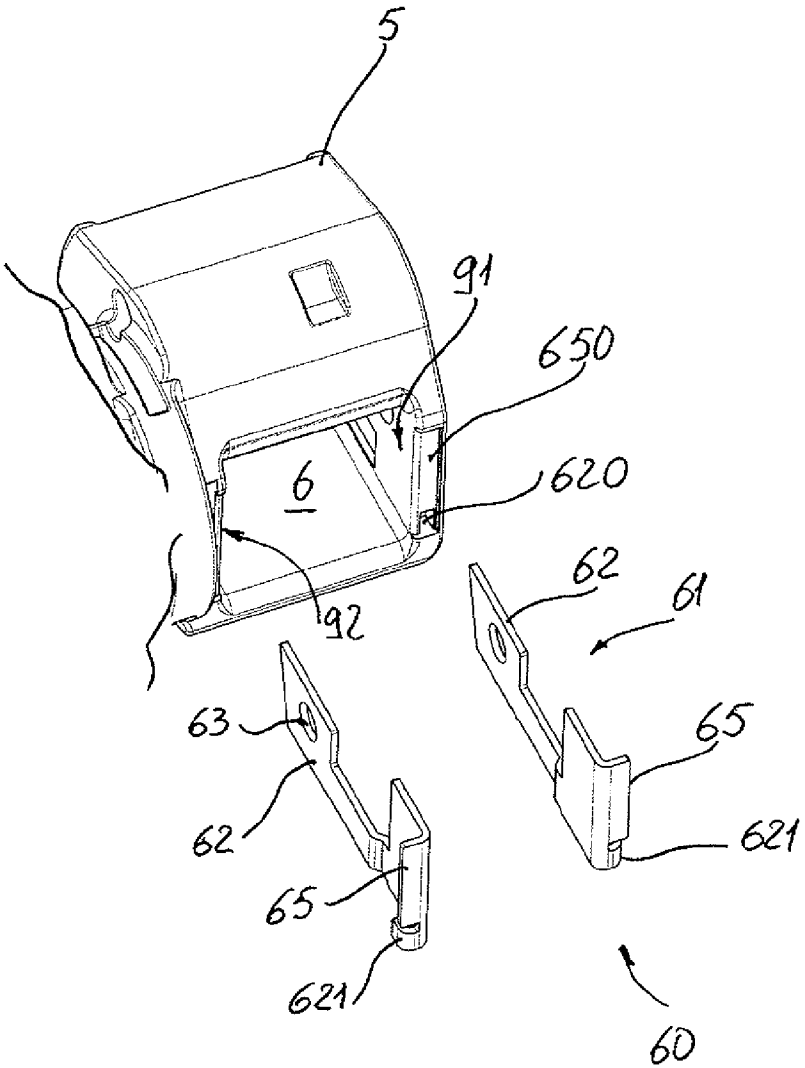
FIG. 12 is a view of a portion of rotating element and of a corresponding element made of ferromagnetic material according to the embodiment of FIG. 11.

A further alternative embodiment, illustrated in FIGS. 11 and 12, envisages that the elements made of ferromagnetic material 60 comprise a fourth plate-shaped body 61 that has a surface 62 substantially mating with at least one portion of the inner surface of said seat 6. As illustrated in said figures, it is preferable for the elements made of ferromagnetic material to comprise two plate-shaped bodies 61, positioned on the opposed side walls 91, 92 of the seat 6. In order to improve the ease of positioning in the seat 6, the plate-shaped bodies 61 moreover comprise engagement means 621 designed to engage in corresponding housings 620, defined on the shaped body 5 of said rotating element.

Preferably, defined on said fourth plate-shaped body 61 is a fourth hole 63 for passage of said pin of the mobile contacts 8. Furthermore, in order to improve the distribution of the mechanical stresses over the rotating element, the fourth shaped body 61 has at least one portion of bent-over edge 65 designed to co-operate with a corresponding coupling surface 650, defined on said shaped body 5.

Preferably said elements made of ferromagnetic material 10, 20, 30, 40, 50, 50 are made of steel.

As mentioned previously, the elements made of ferromagnetic material enable increase of the electrodynamic strength of the circuit breaker and consequently improve the performance thereof, all other conditions being equal. It may in fact be noted that, also with a covering of just approximately 25% of the inner surface of the seat 6 of the mobile contacts, which may be obtained, for example, with the elements of FIGS. 11 and 12, it is possible to obtain an increase in the electrodynamic strength of approximately 8% (from 45 kA to 49 kA, with a voltage of 690 V, all other conditions being equal). Using, instead, the elements of the solution illustrated in FIG. 4, which forms a covering of approximately 45% of the internal surfaces of the seats 6, it is possible to increase the electrodynamic strength by approximately 13% (from 45 kA to 51 kA with a voltage of 690 V, all other conditions being equal). The data indicated above refer to the particular cases that form the subject of the experimentation, but may vary considerably in an absolute sense, by applying the inventive idea to switches with different basic characteristics. These results are in any case of considerable importance in so far as they highlight that it is possible to obtain switches with substantially improved performance, without intervening markedly on the structure and on the essential components of the switch itself.

On the basis of what has been described above, it may be seen that the single-pole or multi-pole device for low-voltage systems, in particular a circuit breaker or a disconnector, according to the invention, enables the problems typically present in the switches of the known art to be solved and improves the electrodynamic strength considerably.

On the basis of the description provided, other characteristics, modifications or improvements are possible and evident to the average person skilled in the branch. Said characteristics, modifications and improvements are hence to be considered as forming part of the present invention. In practice, the materials used, as well as the contingent dimensions and shapes, may be any whatsoever according to the needs and the state of the art.

We claim:

1. A single-pole or multi-pole switching device for low-voltage systems comprising:

an outer casing containing for each pole at least one fixed contact and at least one mobile contact that can be coupled to/uncoupled from one another;

a rotating element comprising a shaped body made of insulating material comprising at least one seat for each pole of said switching device, said seat being designed to house at least one mobile contact of a corresponding pole;

a control mechanism, operatively connected to said rotating element for enabling movement thereof;

one or more elements made of ferromagnetic material, set in a position corresponding to at least one portion of the inner surface of said at least one seat of said mobile contact, wherein said one or more elements made of ferromagnetic material form a coating of said one portion of the inner surface of said at least one seat.

2. The device according to claim 1, wherein said one or more elements made of ferromagnetic material are set in a position corresponding to at least one first side wall of said seat.

3. The device according to claim 1, wherein said one or more elements made of ferromagnetic material are set in a position corresponding to at least one first side wall and one second side wall of said seat.

4. The device according to claim 1, wherein said rotating element comprises at least one pin of the mobile contacts, passing through corresponding holes, defined in said shaped body.

5. The device according to claim 4, characterized in that said one or more elements made of ferromagnetic material interact operatively with said pin of the mobile contacts and with said shaped body.

6. The device according to claim 4, wherein said one or more elements made of ferromagnetic material comprise a first shaped body having a hollow portion with substantially rectangular cross section, the outer surface of which substantially mates with at least one portion of the inner surface of said seat.

7. The device according to claim 6, wherein said one or more elements made of ferromagnetic material comprise a first tab and a second tab that extend from said hollow portion and engage in corresponding housings defined in said seat.

8. The device according to claim 7, wherein a first hole and a second hole for passage of said pin of the mobile contacts are defined on said first tab and said second tab.

9. The device according to claim 8, wherein at least one part of the outer perimeter of said hollow portion has a bent-over edge, designed to co-operate with a corresponding coupling surface, defined on said shaped body.

10. The device according to claim 7, wherein a third hole for passage of said pin of the mobile contacts is defined on a third tab.

11. The device according to according to claim 4, wherein said one or more elements made of ferromagnetic material comprise a second shaped body and a third shaped body, said second and third shaped bodies each having a first hollow portion with substantially U-shaped cross section, defined by a first wall, a second wall and a third wall substantially perpendicular to one another, the outer surface of said hollow portion substantially mating with at least one portion of the inner surface of said seat, a third tab extending from said second wall and engaging in corresponding housings, defined in said seat, said second and third shaped bodies being inserted in said seat so that the respective U-shaped hollow portions face one another.

12. The device according to claim 11, wherein said second and third shaped bodies have engagement means, designed to engage in corresponding housings, defined on said shaped body of said rotating element.

13. The device according claim 4, wherein said one or more elements made of ferromagnetic material comprise a fourth plate-shaped body that has a surface substantially mating with at least one portion of the inner surface of said seat, said fourth shaped body moreover comprising engagement means, designed to engage in corresponding housings, defined on said shaped body of said rotating element.

14. The device according to claim 13, wherein a fourth hole for passage of said pin of the mobile contacts is defined on said fourth plate-shaped body.

15. The device according to claim 14, wherein said fourth shaped body has at least one portion of bent-over edge, designed to co-operate with a corresponding coupling surface defined on said shaped body.

16. The device according to claim 1, wherein said one or more elements made of ferromagnetic material comprise means for crimping to said shaped body, designed to favor coupling between said one or more elements made of ferromagnetic material and said shaped body.

17. The device according to claim 1, wherein said one or more elements made of ferromagnetic material are made of steel.

18. The device according to claim 1, wherein the low-voltage systems is a circuit breaker or a disconnector.

* * * * *